US005370512A

United States Patent [19]

Fujitani et al.

[11] Patent Number: 5,370,512

[45] Date of Patent: Dec. 6, 1994

[54] SCROLL TYPE COMPRESSOR HAVING A LEAK PASSAGE FOR THE DISCHARGE CHAMBER

[75] Inventors: Makoto Fujitani; Yukio Nagato, both of Nagoya; Toshiyuki Shikanai, Aichi, all of Japan

[73] Assignee: Mitsubishi Jukogyo Kabushiki Kaisha, Tokyo, Japan

[21] Appl. No.: 143,933

[22] Filed: Oct. 27, 1993

[30] Foreign Application Priority Data

Oct. 30, 1992 [JP] Japan ..... 4-314336

[51] Int. Cl.[5] ..... F04C 18/04

[52] U.S. Cl. ..... 418/55.2

[58] Field of Search ..... 418/55.1, 55.2

[56] References Cited

U.S. PATENT DOCUMENTS 4,417,863 11/1983 Ikegawa et al. ..... 418/55.2
4,678,415 7/1987 Hirano et al. ..... 418/55.2

FOREIGN PATENT DOCUMENTS 54-7604 1/1979 Japan .
57-146086A 9/1982 Japan .
58-135393 8/1983 Japan .
63-138186 6/1988 Japan ..... 418/55.2
63-126578 8/1988 Japan .
1294982 11/1989 Japan ..... 418/55.2
2169886 6/1990 Japan ..... 418/55.2
4234590 8/1992 Japan ..... 418/55.2

*Primary Examiner*—John J. Vrablik
*Attorney, Agent, or Firm*—Arnold, White & Durkee

[57] ABSTRACT

The present invention relates to a scroll type compressor. The compression gas in a discharge chamber is made to flow into a backside small sealed chamber through a leak passage provided before the position on the revolution angle of the revolving scroll, whereat the back side of a volute wrap of the revolving scroll starts to cross a discharge opening and at the same time a pair of small sealed chambers begin to communicate with the discharge chamber.

7 Claims, 6 Drawing Sheets

SCROLL TYPE COMPRESSOR HAVING A LEAK PASSAGE FOR THE DISCHARGE CHAMBER

FIELD OF THE INVENTION AND RELATED ART STATEMENT

In FIG.4, a housing 1 is constituted from a housing main body la, a front housing 1*b* attached to the housing main body la with a bolt 2*a* and a front cover 1*c* screwed to the front housing 1*b* by means of a bolt 2*b*. An end potion of the front housing 1*b* is inserted into an open end of the housing main body 1*a*. A rotary shaft 3 is rotatably supported in the housing 1 by means of bearings 4*a* and 4*b*.

In the inside of the housing 1, there are provided a stationary scroll 10 and a revolving scroll 20.

The stationary scroll 10 comprises an end plate 11 and a volute wrap 12 provided inwardly and vertically to the end plate 11, the end plate 11 having a discharge opening 13 formed in the center part thereof. The stationary scroll 10 is fastened to the housing main body la being hermetically sealed by means of a bolt 2*c* with the peripheral surface of the end plate 11 disposed in close contact with the inner circumferential surface of the housing main body 1*a*. With this construction, a discharge cavity 31 is defined outside the end plate 11 and an inlet chamber 32 is defined inside thereof.

The revolving scroll 20 comprises an end plate 21 and a volute wrap 22 provided vertically to the inner surface of the end plate 21, while on the outside of the end plate 21 a recessed portion 23 is formed in the center part thereof. The volute wrap 22 has substantially the same shape as the volute wrap 12 of the above stationary scroll 10. The revolving scroll 20 holds a bush 5 in the recessed portion 23 interposing a bearing 4*c* therebetween, and an eccentric pin 3*a* projected from the end of the rotation shaft 3 is rotatably fitted in an eccentric hole 5*a* of said bush 5. Between the peripheral portion of the end plate 21 of the revolving scroll 20 and the peripheral portion of the front housing 1*b*, a rotation blocking mechanism 6 is mounted concurrently serving as a thrust bearing member.

The revolving scroll 20 and the stationary scroll 10 are mutually engaged, as shown in FIG.4, being arranged in the eccentric relationship to each other with a revolving radius δ and being slid to each other by the angle 180°. A tip seal 14 embedded in the top of the volute wrap 12 is disposed in close contact with the inner surface of the end plate 21, and a tip seal 24 laid in the top of the volute wrap 22 is disposed in close contact with the inner surface of the end plate 11, and concurrently the volute wrap 12 and the volute wrap 22 touch each other in line contact at a plurality of places on their side surfaces. In this way, a plurality of small sealed chambers 33, 34 are defined being disposed approximately in the symmetrical relationship to the centering point of the vortex.

An inlet chamber 35 and a discharge chamber 36 are built in the housing main body 1*a*, where the inlet chamber 35 communicates with the inlet chamber 32 through an inlet port 35*a* prepared at the position opposite to the outer periphery of the volute wraps 12 and 22, and the discharge chamber 36 communicates with the discharge cavity 31 through a through hole 36*a*.

When the rotation shaft 3 is rotated, the revolving scroll 20 is driven by means of a revolution drive mechanism constituted from such as the eccentric pin 3*a*, bush 5 and bearing 4*c*. The revolving scroll 20 revolves on a circular orbit with a radius 6 which is centered on the center 0 of the stationary scroll 10, while being prevented from rotation by the rotation blocking mechanism 6.

As the revolving movement of the revolving scroll 20 proceeds, the line contact portions between the volute wraps 12 and 22 gradually shift toward the center of the vortex, and consequently, the small sealed chambers 33, 34 shift toward the center of the vortex reducing their volumes.

When the revolving scroll 20 revolves 90° in the direction of an arrow from the position shown in FIG.-5(*a*), the condition shown in FIG.5(*b*) is obtained. When the revolving scroll 20 revolves 180°, then it shifts to the condition of FIG.5(*c*) and for a revolving angle 270°, the condition of FIG.5(*d*) is attained.

During this period, points $A_1$, $B_1$ and $A_2$, $B_2$ in which the sides of volute wraps 12 and 22 mutually contact gradually shift to the center of the vortex and correspondingly the volume of the small sealed chambers 33, 34 are reduced slowly, and when it comes to a condition shown in FIG.5(*d*), the pair of small sealed chambers 33, 34 communicate with a discharge chamber 37. Then, the gas compressed in each small sealed chamber 33, 34 is discharged from the discharge chamber 37 into the discharge cavity 31 through the discharge opening 13 and a discharge valve 7 which is push opened.

The ends of the outer peripheries of the volute wraps 12 and 22 start to open respectively from the state shown in FIG.5(*a*), then intake fresh fluid from openings at respective outer periphery ends while shifting successively to the states shown in FIG.5(*b*), FIG.5(*c*), and FIG.5(*d*), and finally return to the state of FIG.5(*a*) with the outer periphery ends of the volute wraps 12, 22 again contact respectively with back sides 22*a*, 12*a* of the volute wraps 22, 12 of the other member newly defining small sealed chambers 33, 34. Hereinafter the above process will be repeated.

When each volume of the small sealed chambers 33, 34 is reduced to a minimum, in other words, when the revolving scroll 20 reaches the revolution angle shown in FIG.6, the small sealed chambers 33, 34 begin to enter the discharging process respectively, and further when the back surface 22*a* of the volute wrap 22 of the revolving scroll 20 begins to cross the discharge opening 13, the small sealed chambers 33, 34 start to communicate with the discharge chamber 37 respectively.

Since the passage area which connects each small sealed chamber 33, 34 and the discharge chamber 37 is small at the initial stage of the discharging process, the gas in each small sealed chamber 33, 34 is excessively compressed thereby increasing a power loss, so that, in order to overcome this trouble, excessive-compression preventing passages 15, 25 are formed respectively in the inner end portion on the belly side 12*b* of the volute wrap 12 and in the inner end portion on the belly side 22*b* of the volute wrap 22.

With the conventional scroll type compressor described above, while it is operated, sometimes pressure Pcf in the belly-side small sealed chamber 33 formed in the belly side of the volute wrap 12 of the stationary scroll 10 becomes higher than pressure Pcb in the back-side small sealed chamber 34 formed in the back side of the volute wrap 12 of the stationary scroll 10.

This phenomenon occurs with the following conditions.

1) A large pressure pulsation is generated in the discharge chamber 37 due to opening and closing operation of the discharge valve 7.

2) Pressure ratio $\Phi = Pd/Pc > (\rho)^k$ where,

Pd: discharge pressure, $\rho$: designed volume ratio, k: polytropic exponent in the Pv diagram, When this phenomenon is once generated due to the above condition 2), it does not disappear until the pressure ratio is substantially reduced.

When this phenomenon is generated, rotation torque reverse to normal rotation torque, that is, reverse torque in the direction reverse to the revolving direction is generated in the revolving scroll 20, and accordingly a gap $\lambda f$ between the belly side **22*b* of the volute wrap 22 of the revolving scroll 20 and the back side 12*a* of the volute wrap 12 of the stationary scroll 10 grows larger than a gap $\lambda b$ between the back side 22*a* of the volute wrap 22 and the belly side 12*b* of the volute wrap 12, and also the leakage of the gas from the discharge chamber 37 to the adjacent belly side small sealed chamber 33 becomes larger than that from the discharge chamber 37 to the small sealed chamber 34**.

When a pressure pulsation occurs in the discharge chamber 37 being caused by closing the discharge valve 7, the pressure in the belly-side small sealed chamber 33 becomes higher than that in the backside small sealed chamber 34, and hence the reverse torque exerts on the revolving scroll 20. Then the gas leaks from the discharge chamber 37 to the adjacent belly-side small sealed chamber 33. When the revolving scroll 20 continues to revolve under the influence of the reverse torque exerted thereon and thence the small sealed chambers 33, 34 communicate with the discharge chamber 37, the pressure in each of the small sealed chambers 33 and 34 becomes equal to each other and from that instant the rotation torque in the positive direction exerts on the revolving scroll 20. However, with reference to the pressure in the small sealed chambers positioned on the outer circumference side of the most inner side small sealed chambers 33, 34, the pressure in the belly-side small sealed chamber has become higher than that in the backside small sealed chamber because of the influence by the gas leaked before, so that the reverse torque again exerts on the revolving scroll 20.

In this way, since the normal and reverse torque alternately exerts on the revolving scroll 20 during its revolving movement, there has been a problem that each time when the small sealed chambers 33, 34 communicate with the discharge chamber 37, in other words, each time the reverse torque changes to the normal torque, noise and vibration are generated due to collision of the parts caused by the play in the rotation blocking mechanism or revolution drive mechanism.

OBJECT AND SUMMARY OF THE INVENTION

An object of the present invention is to provide a scroll type compressor which can reduce vibration and noise to be generated by the alternating effects of the normal and reverse torque which exerts alternately on a revolving scroll 20.

The present invention has been developed to solve the above problem, and the gist of which is embodied in a scroll type compressor which comprises a stationary scroll and a revolving scroll, each of which is constituted from an end plate and a volute wrap vertically provided on the end plate, wherein the stationary scroll and the revolving scroll are engaged with each other with a phase difference therebetween to form a pair of small sealed chambers in such a manner that the above pair of small sealed chambers move toward the center of the vortex while reducing their volumes due to the revolving movement of the above revolving scroll, so as to come to communicate with a discharge chamber positioned in the central part of the scrolls and to discharge the gas compressed in the above pair of small sealed chambers to a discharge cavity from the discharge chamber through a discharge opening; and a leak passage is provided in at least one of the above pair of scrolls in order to leak the compressed gas in the above discharge chamber to the above backside small sealed chamber, the leak passage establishing communication between the above discharge chamber and the backside small sealed chamber located on the back side of the above stationary scroll being disposed adjacent to the discharge chamber, the communication being established at a point before the position on the revolution angle of the revolving scroll at which each of the above pair of small sealed chambers begin to communicate with the above discharge chamber as soon as the back side of the volute wrap of the above revolving scroll starts to cross the above discharge opening.

The above leak passage can be provided in the range of the revolution angle of 30° to 90° before the position on the revolution angle position of the revolving scroll described above.

The leak passage can also be constructed with grooves made in a form of a volute wrap.

It is preferable to form the above groove such that it becomes gradually deeper toward the center of vortex.

It is also possible to form the leak passage in the belly side of the volute wrap of the revolving scroll.

The leak passage can also be formed on the back side of the volute wrap of the stationary scroll.

The leak passage can further be constructed adjacent to an excessive-compression preventing passage provided on the center side of the position on the revolution angle of the above revolving scroll.

Since the present invention has the above constitution, when the revolving scroll travels in the revolving movement and reaches a point on a predetermined revolution angle situated before the position with the revolution angle at which the back side of the volute wrap starts to cross the discharge opening and at the same time a pair of small sealed chambers begin to communicate with the discharge chamber, the compression gas in the discharge chamber flows into the small sealed chamber on the back side of the revolving scroll through the leak passage. Then, the pressure in the small sealed chamber on the back side of the revolving scroll is raised higher than that in the belly-side small sealed chamber in the belly side of the stationary scroll, and hence a normal direction torque on the revolving scroll is increased to prevent a reverse direction torque from exerting on the revolving scroll. Therefore, the periodic noise or vibration which may be caused by the revolving movement of the revolving scroll can be reduced.

Also, since the apparent volume of the discharge chamber is increased by communicating with the small sealed chamber through the leak passage, the pulsation of the discharge pressure is reduced, and consequently the noise which may De caused by the discharge pressure pulsation can also be reduced.

BRIEF DESCRIPTION OF THE DRAWINGS

FIG.1 shows a first embodiment of the present invention, wherein

FIG.2 shows characteristics of the above embodiment, wherein

DETAILED DESCRIPTION OF PREFERRED EMBODIMENTS

Figure 1A:
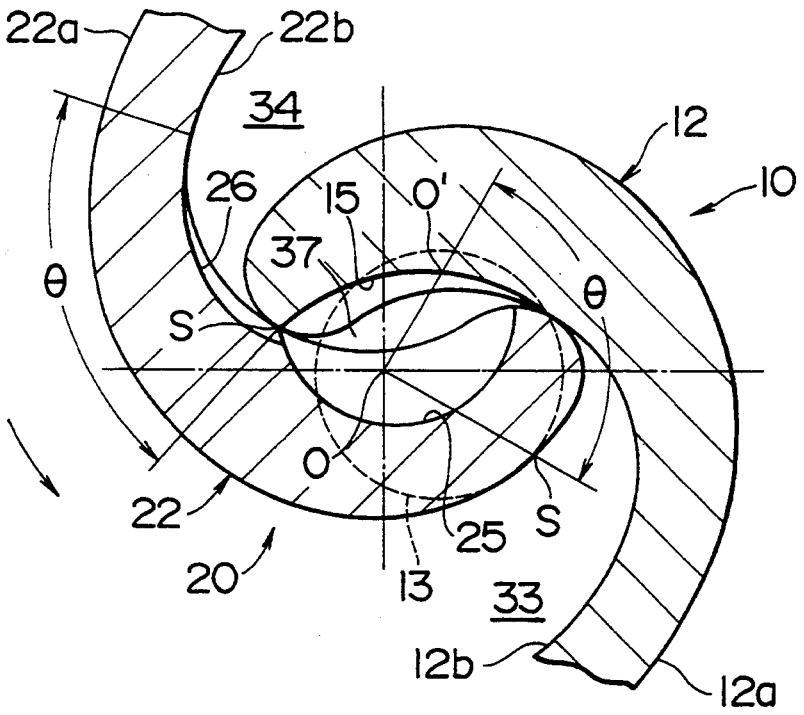
FIG.1(A) is a partial sectional view showing an inner end portion of each volute wrap.
Figure 1B:
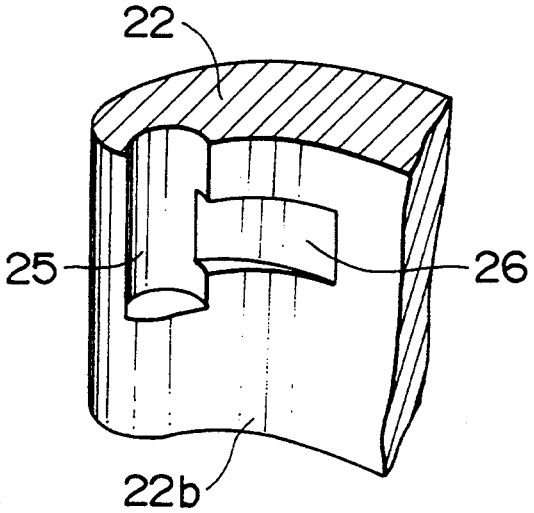
FIG.1(B) is a perspective view of an inner end portion of a revolving scroll.

A first embodiment of the present invention is shown in FIG.1(A) and FIG.1(B), wherein FIG.1(A) is a partial sectional view of an inner end portion of each volute wrap, and FIG.1(B) is a perspective view showing an inner end portion of a volute wrap of a revolving scroll.

As shown in FIG.1(A), when a revolving scroll 20 has revolved 160° over the revolution angle, a back side 22*a* of a volute wrap 22 of the revolving scroll 20 starts to cross a discharge opening 13, and a backside small sealed chamber 34 positioned on the back side of a stationary scroll 10 and a belly-side small sealed chamber 33 located on the belly side of the stationary scroll 10 begin to communicate with a discharge chamber 37 respectively. A leak passage 26 for establishing communication between the discharge chamber 37 and the backside small sealed chamber 34 is formed on a belly-side surface 22*b* of the volute wrap 22 of the revolving scroll 20 in the range of a predetermined revolution angle $\theta$ before the position S on the revolution angle which is marked by thus revolved revolving scroll 20.

This leak passage 26 is prepared such that its depth is gradually increased toward the center portion of the vortex and communicates with an excessive-compression preventing passage 25 at the inner end thereof.

Figure 4:
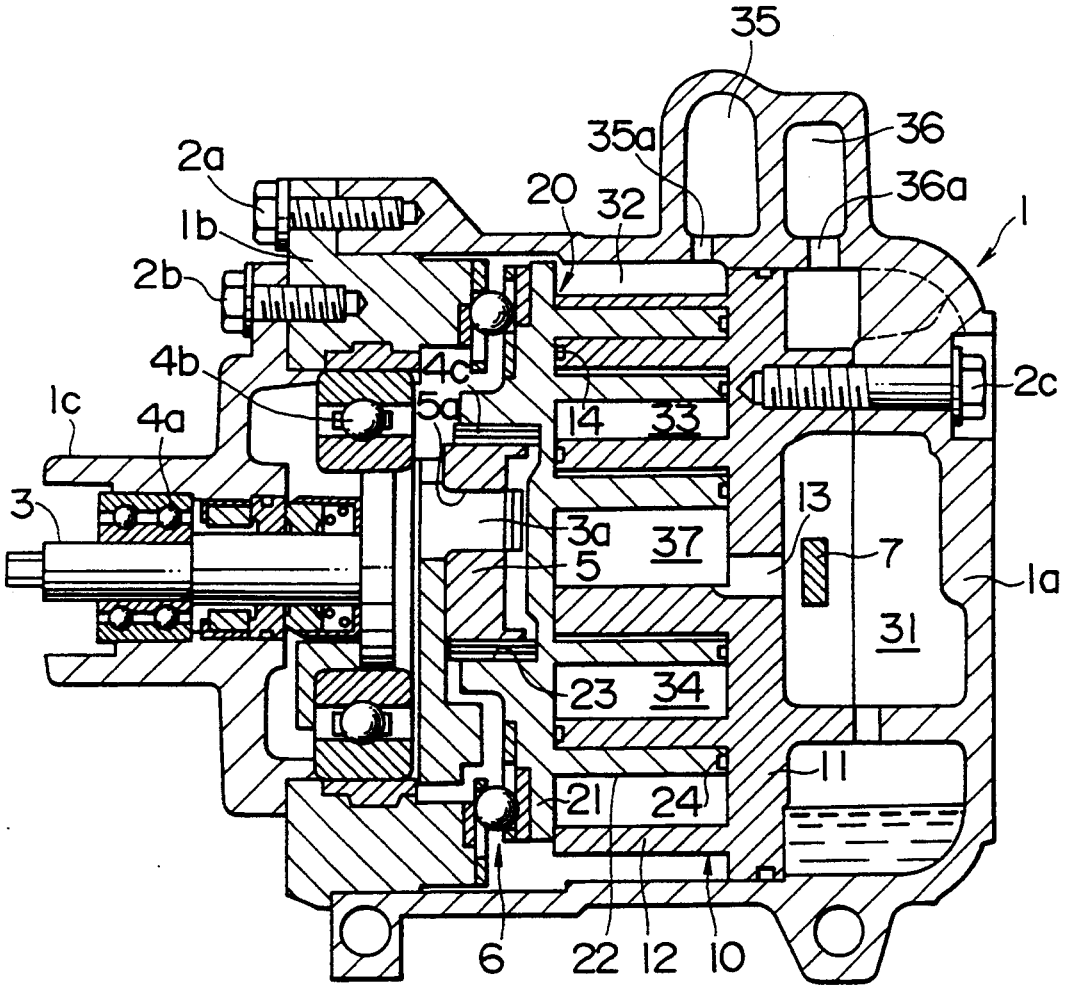
FIG. 4 RELATED ART
FIG.4 is a sectional view showing an example of a scroll type compressor of a prior art.
Figure 5A:
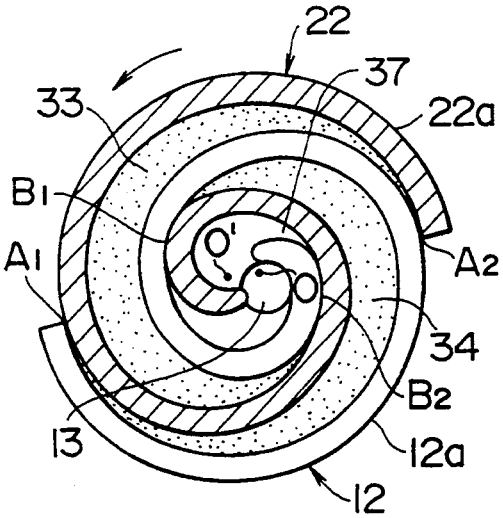
FIG. 5(a) RELATED ART
FIGS.5(*a*)–5(*b*) are sectional views showing the engaging conditions of respective scrolls which change according to the revolving positions with reference to the scroll type compressor of the prior art.
Figure 5B:
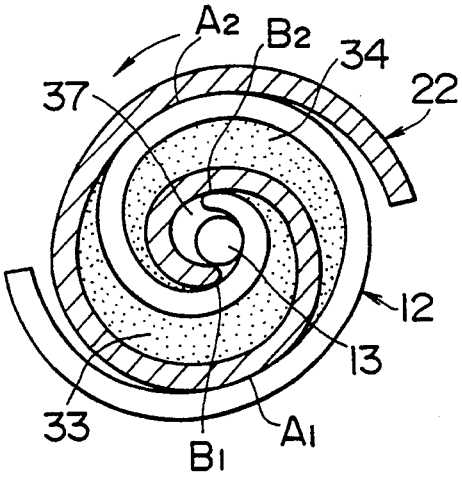
FIG. 5(b) RELATED ART
Figure 5C:
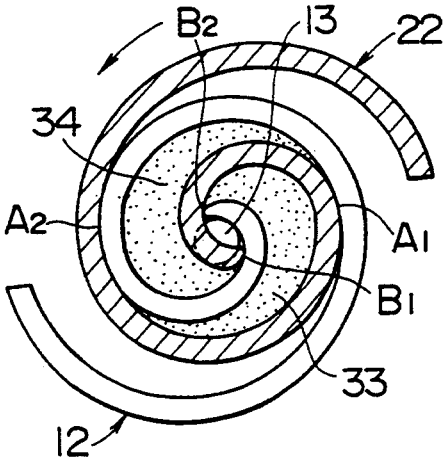
FIG. 5(c) RELATED ART
Figure 5D:
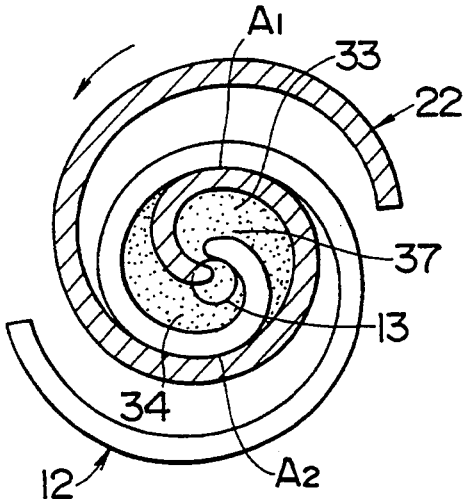
FIG. 5(d) RELATED ART
Figure 6:
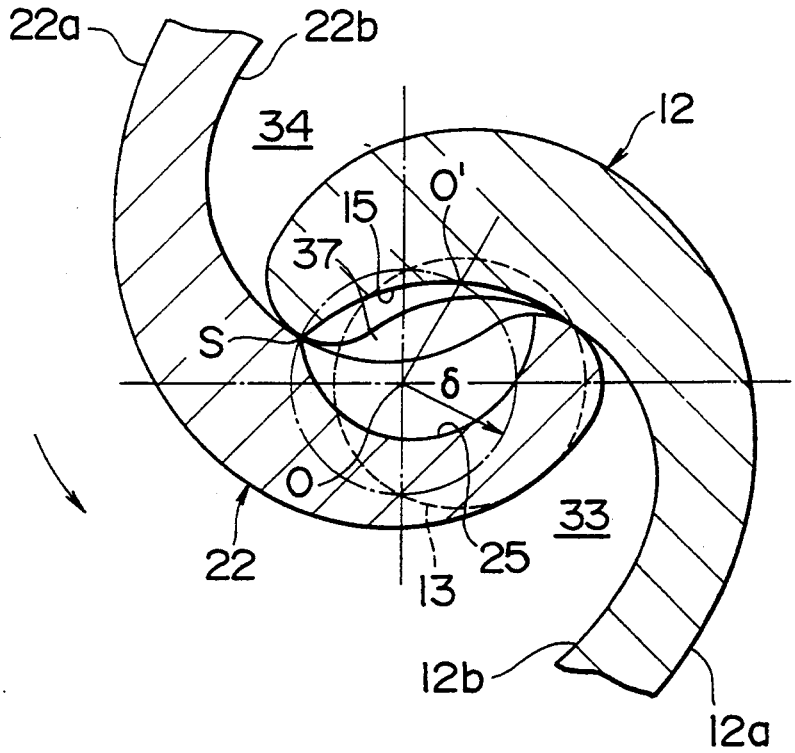
FIG. 6 RELATED ART
FIG.6 is a partial sectional view showing an inner end portion of each volute wrap with reference to the scroll type compressor of the prior art.

The constitution of other parts is the same as that of the conventional type compressor shown in FIG.4 to FIG.6 and the same reference numeral is given to the member corresponding to each other.

When the revolving scroll 20 reaches a position on a predetermined revolution angle by its revolving movement, the compression gas in the discharge chamber 37 flows into the backside small sealed chamber 34 through the leak passage 26.

Figure 2A:
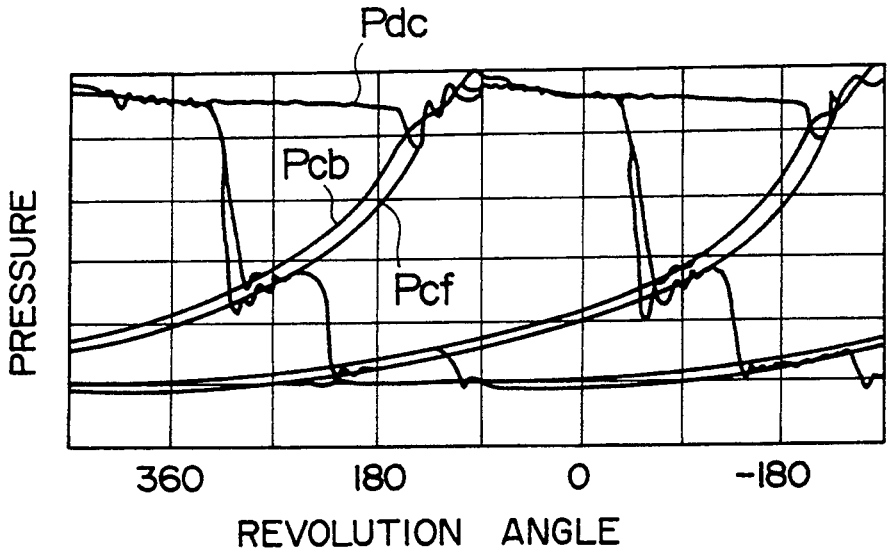
FIG.2(A) is a diagram showing the change of pressure in the small sealed chamber.

Thus, as shown in FIG.2(A), pressure Pcb in the backside small sealed chamber 34 becomes higher than that Pcf of the belly-side small sealed chamber 33, and thereupon the normal direction torque of the revolving scroll 20 is increased so that the constant normal direction torque exerts on the revolving scroll 20 during its revolving movement while preventing the reverse torque.

Figure 2B:
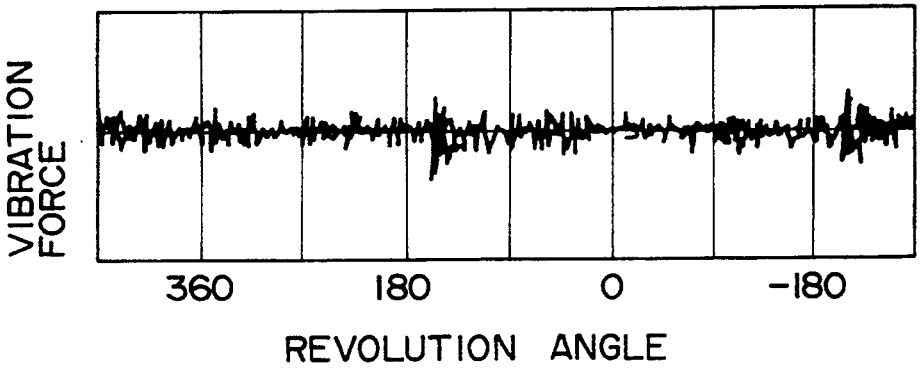
FIG.2(B) is a diagram showing the change of vibration force in the compression chamber.

Therefore, as shown in FIG.2(B), the vibration force to be periodically generated due to the revolving movement of the revolving scroll 20 also becomes considerably small compared with the conventional vibration force, resulting in the remarkably reduced level of noise and vibration. Further, when the discharge chamber 37 communicates with the backside small sealed chamber 34 through the leak passage 26, the apparent volume of the discharge chamber is increased so that the discharge pressure pulsation in the discharge chamber 37 is also controlled smaller.

It is to be noted that the leak passage 26 is preferably constructed in the range which covers at least the revolution angle of 30° before the aforementioned starting position S on the revolution angle of the revolving scroll 20, but if the leak passage extends over the revolution angle of 60°, it becomes not only difficult to achieve an expected effect but also the performance of the scroll type compressor will deteriorate.

It is also to be noted that if the leak passage 26 is constructed in such a way that the depth of the leak passage is gradually increased toward the center of the volute wrap 22, it becomes possible to make the compressed gas flow smoothly into the small sealed chamber 34.

Further, if the leak passage 26 is constructed such that the inner end thereof communicates with the excessive-compression preventing groove 25, the compression gas will be allowed to flow more smoothly into the small sealed chamber 34.

Figure 3:
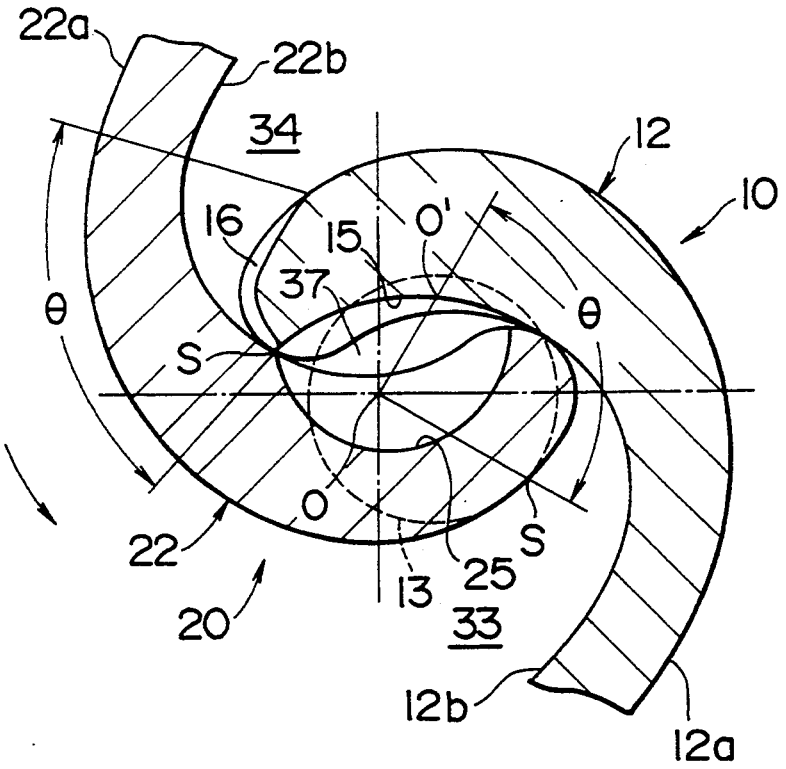
FIG.3 is a partial sectional view showing a second embodiment of the present invention, corresponding to FIG.1(A).

In the above embodiment, the leak passage 26 is formed in the belly-side surface 22*b* of the revolving scroll 20, but it is acceptable to construct a leak passage 16 in the backside surface 12*a* of the stationary scroll 10, as shown in FIG.3. It is to be noted that, in this case also, the leak passage 16 is preferably constructed in the range which covers at least 30° of the revolution angle before the starting position S on the revolution angle of the revolving scroll 20.

We claim:

1. A scroll-type compressor including a stationary scroll and a revolving scroll, having a volute wrap set up at an end plate thereof respectively are engaged with each other at a staggered phase so as to form a pair of compression chambers, said pair of compression chambers are moved to the side of center of a vortex due to the revolution of said revolving scroll while reducing: the volume of said compression chambers until said compression chambers come in communication with a central discharge chamber thereby discharging gas compressed in said compression chambers from said discharge chamber through a discharge port, comprising a gas leak passage formed along the surface of a volute wrap of at least one of said pair of scrolls so that when the back surface of the wrap of said revolving scroll starts to traverse said discharge port and just before the position of revolving angle of said revolving scroll when said pair of compression chambers start to communicate with said discharge port, said gas leak passage can communicate said discharge chamber and only said compression chamber positioned at the back side of said stationary scroll thereby leaking compressed gas in said discharge chamber into said back-side compression chamber.

2. A scroll type compressor according to claim 1, wherein said leak passage is provided in the range of the revolution angle of 30° to 90° before said position on the revolution angle of said revolving scroll.

3. A scroll type compressor according to claim 1, wherein said leak passage is formed on the belly side surface of the volute wrap of the revolving scroll.

4. A scroll type gas compressor according to claim 1, wherein said leak passage is provided on the backside surface of the volute wrap of the stationary scroll.

5. A scroll type compressor according to claim 1, wherein said leak passage is constructed adjacent to an excessive-compression preventing passage provided on the center side of the position on the revolution angle of said revolving scroll.

6. A scroll type compressor according to claim 1, wherein said at least leak passage is constructed with grooves made in a form of said volute wrap.

7. A scroll type compressor according to claim 3, wherein said groove is constructed such that the depth of which is gradually increased toward the center of the vortex.

* * * * *